US006503119B1

(12) United States Patent
Lapointe

(10) Patent No.: US 6,503,119 B1
(45) Date of Patent: Jan. 7, 2003

(54) PARACHUTE TOY

(76) Inventor: Brian Keith Lapointe, 25 Cottage Dr., West Yarmouth, MA (US) 02673

( * ) Notice: Subject to any disclaimer, the term of this patent is extended or adjusted under 35 U.S.C. 154(b) by 0 days.

(21) Appl. No.: 09/683,476

(22) Filed: Jan. 4, 2002

(51) Int. Cl.[7] ..... A63H 27/00

(52) U.S. Cl. ..... 446/34; 446/49; 244/138 R; 244/142; 244/145

(58) Field of Search ..... 446/34, 49, 50, 446/51, 52, 53, 54

(56) References Cited

U.S. PATENT DOCUMENTS 4,399,969 A * 8/1983 Gargano
4,440,366 A * 4/1984 Keeler et al.
4,705,238 A * 11/1987 Gargano
4,771,970 A * 9/1988 Sutton
4,865,272 A * 9/1989 Schwarz
5,005,785 A * 4/1991 Puskas
5,069,404 A * 12/1991 Bouchard
5,082,210 A * 1/1992 Morehead, Jr.
5,174,528 A * 12/1992 Puskas
5,201,482 A * 4/1993 Ream

* cited by examiner

*Primary Examiner*—Derris H. Banks
*Assistant Examiner*—Ali Abdelwahed

(57) ABSTRACT

A rectangular shaped parachute toy, designed to suggest a modern day parafoil, but constructed with a single fabric layer canopy, for simplicity and more rapid opening of the chute. This invention, incorporates the use of two oversized shrouds, each leading up to a section of lightweight mesh, which distributes the forces that each shroud imparts on the canopy, and thereby offers a child an easy to use parachute toy, that is nearly impossible to tangle, a problem commonly found in most parachute toys. The rectangular shape of the canopy and offset attachment of the shrouds results in a parachute toy, which is directional and easy to control. As the parachute descends, it travels forward in the direction that the figure is facing and turns in the direction of a shortened shroud.

3 Claims, 2 Drawing Sheets

PARACHUTE TOY

BACKGROUND OF INVENTION

1. Field of the Invention

This invention relates generally to improvements in parachute toys and more particularly to an improved parachute toy, which is simple and easy to use and offers a child a more realistic experience, since the parachute moves forward in the direction the figure is facing as it descends and turns in the direction of a shortened shroud.

2. Prior Art

For many years, parachute toys have been a popular means of providing amusement to children of all ages. A number of different designs have been attempted in an effort to improve the performance or usefulness of parachutes, however few if any of these improvements have been either practical or pertinent to parachute toys. U.S. Pat. Nos. 1,649,934 and 2,993,667 disclose different means for improving the descent of parachutes by reducing the swinging movement, that is typically experienced by parachutes as they fall through the atmosphere toward the earth. While these inventions may provide practical solutions, they would not be cost effective when applied to amusement toys.

U.S. Pat. No. 3,536,279 discloses a means for allowing a child to more easily launch a parachute toy into the air. This device incorporates a hollow ball, which contains the chute as it is launched. This invention would be difficult if not impossible to apply to a parachute toy, that lowers a figure to the ground. It is also a non-directional design, which cannot be adjusted by the user, so that it moves in a pre-determined horizontal direction as it descends.

U.S. Pat. No. 5,755,405 discloses a simple parachute design, which could easily and cost effectively apply to an amusement toy for children. This invention, however, would not provide a child with a means for controlling the descent of a parachute, so that increased excitement and realism could be experienced as a part of the play pattern.

The need exists for an improved parachute toy, which is simple and easy to use and cost effective to manufacture. The need also exists for a parachute toy, which can provide increased excitement and play value, by offering a child the ability to have a more realistic play experience. My invention provides this, because, during play, it appears as if the plastic figure is controlling the movement of the parachute and the direction of descent. My invention also allows the child to decide if the parachute will move strait forward or turn to the left or to the right as it descends.

SUMMARY OF THE INVENTION

This invention is concerned with providing a parachute toy, which provides increased amusement and play value through a more realistic visual experience. This is accomplished by employing a rectangular canopy that suspends a figure from two oversized shrouds, which can be individually shortened so that the figure can be directed to turn towards the left or right as it descends.

It is therefore one object of this invention, to provide a parachute toy that creates a more realistic visual experience for a child, by employing a rectangular shaped canopy, which resembles a modern day parafoil and descends in a similar way, moving forward in the direction that the figure is facing during the descent.

It is a further object of this invention, to provide a parachute toy that incorporates two oversized shrouds, which can be easily and individually shortened to influence the descent direction of the toy, while remaining tangle free throughout the play period.

Other objects and advantages of this invention will become apparent, from a consideration of the drawings and ensuing description.

DETAILED DESCRIPTION

Figure 1:
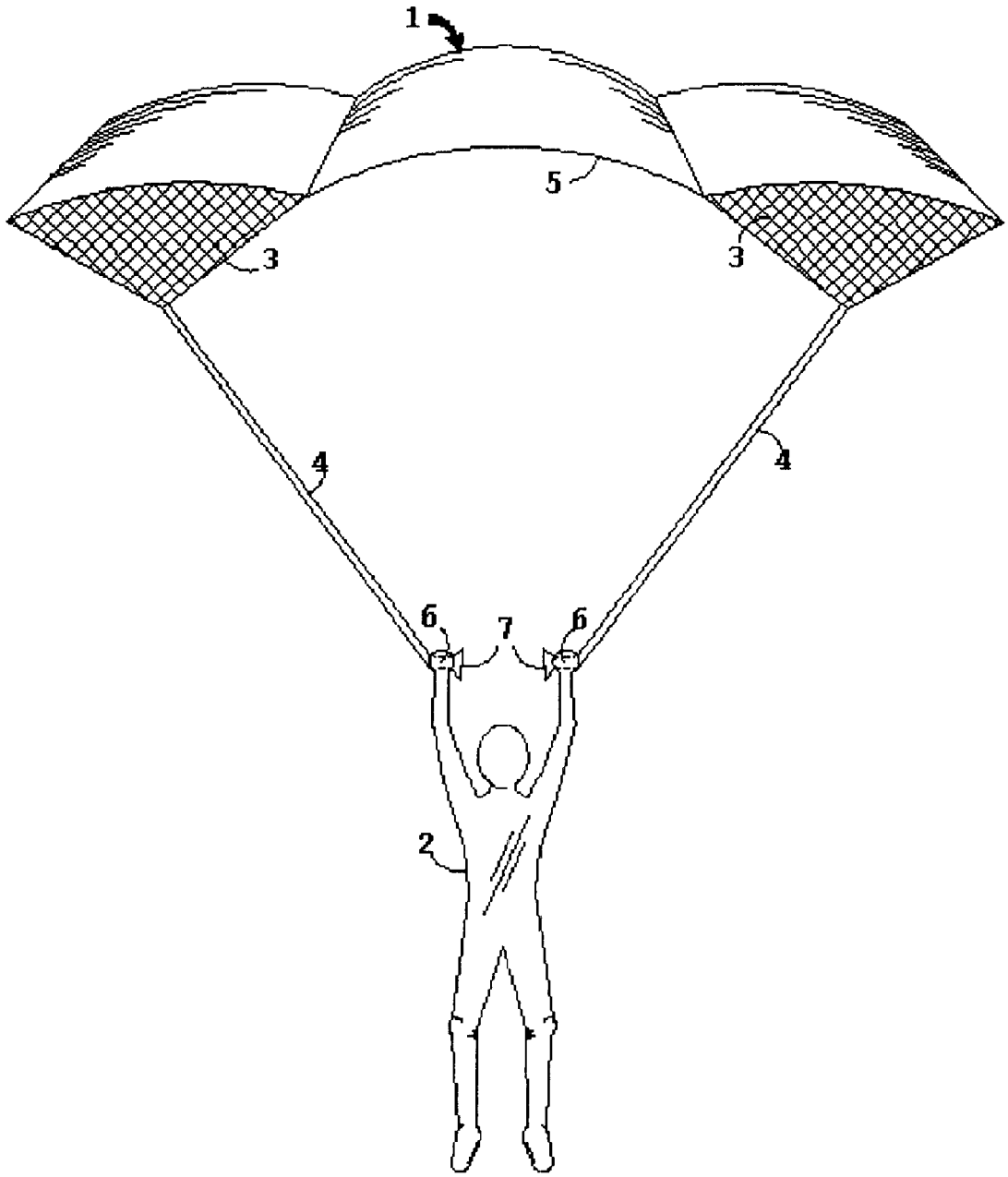
FIG. 1 Is a perspective view of the preferred embodiment of the invention depicting an adult figure suspended from the open cloth canopy by two oversized shrouds, which are each attached to a section of lightweight mesh, that is sewn to the canopy along the butted outer edges.
Figure 2:
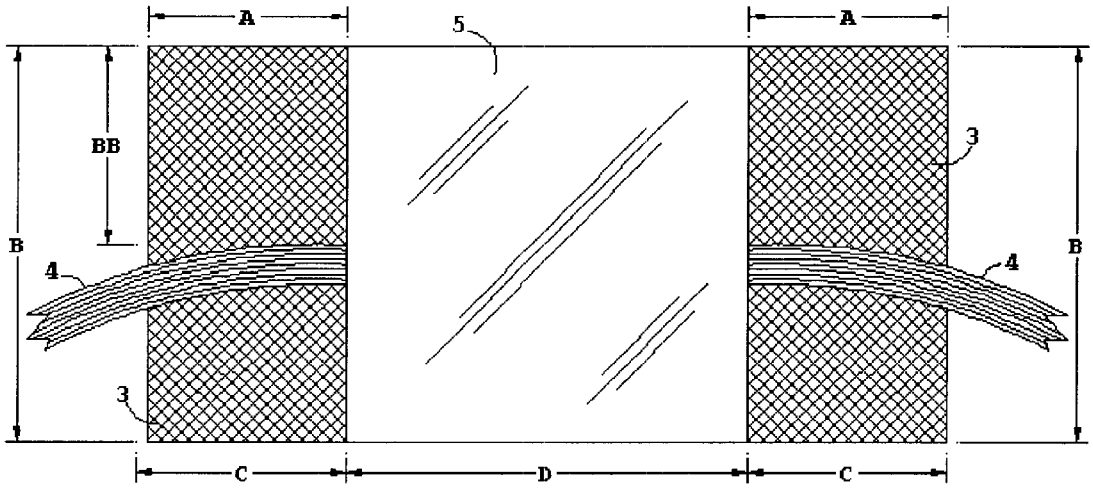
FIG. 2 Is a view of the underside of the canopy assembly laid flat on a planar surface.

In the preferred embodiment, FIG. 1 discloses a parachute toy 1, comprised of a parachute canopy 5 formed by a panel of thin flexible lightweight material, such as rip-stop nylon, which is substantially impervious to the passage of air and cut into a rectangular shape that measures twice its length as its width. A rectangle measuring twenty-one inches long and eleven inches wide was found to adequately slow the descent of a seventeen gram plastic FIG. 2. Canopy 5 is secured along its edge A, B, C, as illustrated in FIG. 2, to two confronting panels of thin flexible sheet material 3, such as lightweight nylon or polyester mesh, which have openings through which air can freely pass and are each not more than twenty five percent of the area of canopy 5. Panels 3 provide a means to distribute the forces of shrouds 4 along edge A, B, C, of canopy 5 where they are secured.

Two shrouds 4, of a ribbon like material at least ⅜ inches wide, are attached to panels 3 along their unsecured edge as illustrated in FIG. 2. Because shrouds 4 are attached at an offset, beginning at midpoint BB, the parachute will travel in a horizontal direction as it descends and the leading edge will always be edge C, D, C, of canopy 5. As illustrated in FIG. 1, shrouds 4 are passed through an opening 6 in the hands of FIG. 2, and finished by folding over and stitching the ends, so they cannot be pulled back out. Opening 6 in the hands of FIG. 2 should be small enough, to require, that a two pound force be applied to the shroud in order to pull it through opening 6. This will ensure adequate holding force, when one shroud is shortened by pulling on the shroud at end 7. When one shroud is shortened, by pulling on end 7, so that at least one additional inch of shroud is pulled through opening 6, the parachute will turn in the direction of the shortened shroud as it descends toward the ground. FIG. 2 must be oriented, so that the front of the figure faces in the direction of edge C, D, C, of canopy 5. This orientation is necessary to achieve a realistic looking horizontal movement during descent, which mimics the forward motion of a real life paratrooper descending beneath a parafoil chute.

What is claimed is:

1. A parachute toy assembly comprising: a rectangular shaped first panel of flexible sheet material impervious to the flow of air therethrough, said first panel forming a parachute canopy for trapping air on its underside as the parachute assembly falls under the force of gravity after having been elevated; two confronting panels of flexible sheet material having openings permitting free passage of air therethrough, said confronting panels being of identical size and shape, each having a surface area which is less than fifty percent of said first panel, each having an identical size and shape of a section of said first panel, and each secured to said first panel along three adjoining edges, such that said confronting panels do not come into contact with each other, with each said confronting panel forming half of a suspension element, with each said confronting panel joined at an offset from its midpoint to a load supporting element, with each load supporting element attached to a load.

2. The parachute toy assembly of claim 1 wherein each load supporting element is frictionally attached to a load.

3. The parachute toy assembly of claim 1 wherein each load supporting element is unadjustably attached to a load.

* * * * *